US007363899B2

(12) United States Patent
Best et al.

(10) Patent No.: US 7,363,899 B2
(45) Date of Patent: Apr. 29, 2008

(54) VALVE DRIVE OF AN INTERNAL COMBUSTION ENGINE

(75) Inventors: Richard Best, Garden City, MI (US); Debora Manther, Royal Oak, MI (US)

(73) Assignee: Schaeffler KG, Herzogenaurch (DE)

( * ) Notice: Subject to any disclaimer, the term of this patent is extended or adjusted under 35 U.S.C. 154(b) by 0 days.

(21) Appl. No.: 11/677,634

(22) Filed: Feb. 22, 2007

(65) Prior Publication Data

US 2007/0193538 A1 Aug. 23, 2007

Related U.S. Application Data

(60) Provisional application No. 60/775,490, filed on Feb. 22, 2006.

(51) Int. Cl.
*F01L 1/02* (2006.01)

(52) U.S. Cl. ..... 123/90.27; 123/90.16; 123/90.44

(58) Field of Classification Search ..... 123/90.27, 123/90.15, 90.16, 90.39, 90.31, 90.44
See application file for complete search history.

(56) References Cited

U.S. PATENT DOCUMENTS 5,205,247 A * 4/1993 Hoffman ..... 123/90.16

FOREIGN PATENT DOCUMENTS

| | | |
|---|---|---|
| DE | 3834715 | 4/1990 |
| EP | 0717174 | 6/1996 |
| GB | 960396 | 6/1964 |
| JP | 59231115 | 12/1984 |

* cited by examiner

*Primary Examiner*—Zelalem Eshete
(74) *Attorney, Agent, or Firm*—Volpe and Koenig, P.C.

(57) ABSTRACT

A valve drive (1) for an internal combustion engine with a lever-type cam follower (7) is provided, which is used for the variable adjustable transmission of a raised section (2) of a cam (3) to a gas-exchange valve (5), in that the cam follower (7) is supported with an end section (13) away from the cam on a pivot bearing (14), which can be positioned variably on a circular arc-shaped displacement path (15), and an end section (6) close to the cam includes a transmission surface (10) in connection with the gas-exchange valve (5), and also with a support (8), wherein a contact surface (9) for the cam (3) is mounted rotatably on this support (8). Here, the center of the displacement path (15) should be essentially identical to the rotational center (17) of the support (8) when the contact surface (9) interacts with a raised section-free base circle (21) of the cam (3).

6 Claims, 3 Drawing Sheets

Fig. 3
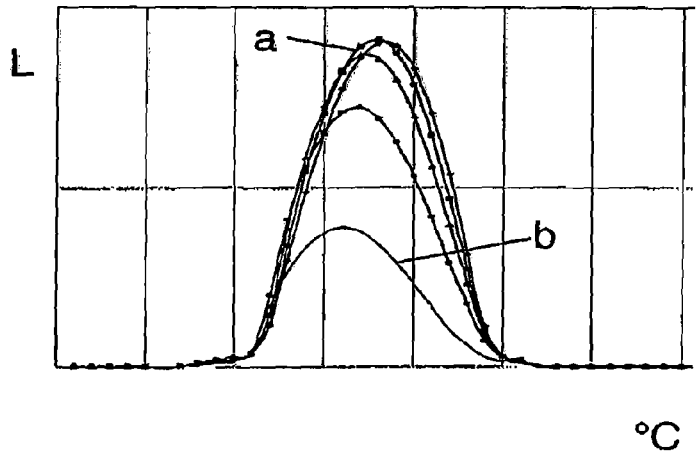
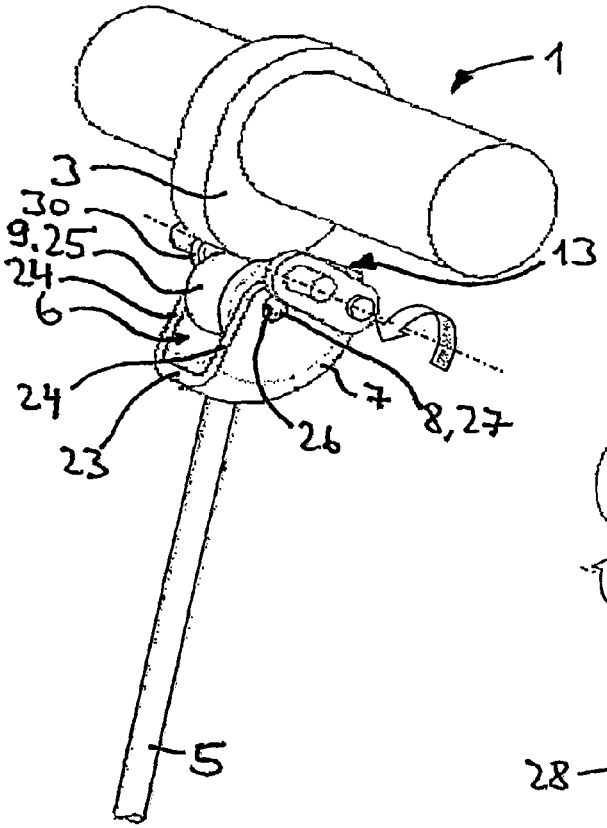
Fig. 4
Fig. 5
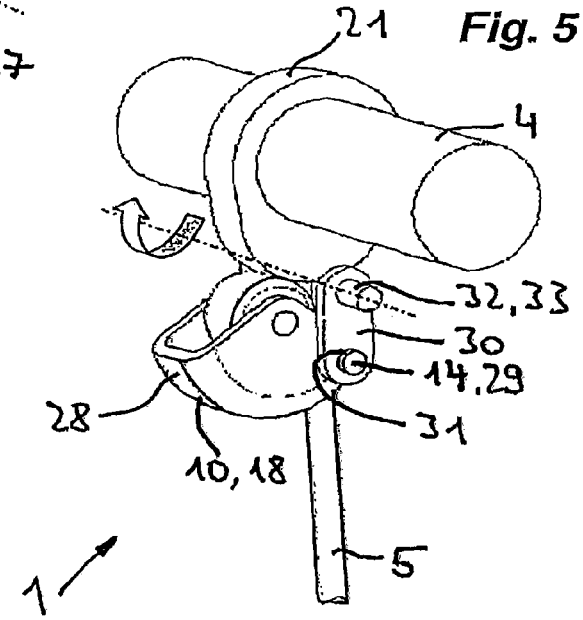

VALVE DRIVE OF AN INTERNAL COMBUSTION ENGINE

FIELD OF THE INVENTION

The invention relates to a valve drive of an internal combustion engine with a lever-type cam follower, which is used for the variable, adjustable transfer of a raised section of a cam of a camshaft to a gas-exchange valve, in that the cam follower is supported with an end section away from the cam on a pivot bearing, which can be positioned variably on a circular arc-shaped displacement path, and an end section close to the cam with a transfer surface in at least indirect active connection with the gas-exchange valve, and also with a support, on which a contact surface for the cam is mounted rotatably.

BACKGROUND OF THE INVENTION

Valve drives with a lever-type cam follower, whose pivot bearing is displaceable for generating a variable opening lift of the gas-exchange valve on a circular arc, are known in the state of the art. In EP 0 717 174 A1, which is considered as a class-forming invention, a valve drive with a rocker lever is shown, whose rocker-lever axis is displaceable on a circular arc concentric with the center axis of the camshaft. According to FIG. 3 of this publication, the changing kinematic relationships of the valve drive in the transfer of the raised section of the cam to the gas-exchange valve lead not only to a variable maximum lift of the gas-exchange valves, but also to a considerable shift in its control times, i.e., the opening and closing times of the gas-exchange valve with reference to the angular position of the cam or crankshaft.

A change to the control times and the maximum lift that is not independent of each other, however, can be undesirable for several reasons. The internal combustion engine is operated, for example, at an operating point close to idling, in which the residual gas content is to be minimized with reference to the smooth running of the internal combustion engine, typically with small valve overlap between the inlet and outlet valves, as well as with a small maximum lift. In contrast, in the partial load region, greater valve overlap for the residual gas preparation is advantageous from exhaust-gas emission and fuel consumption reasons, while, however, the maximum lift of the gas-exchange valve is to remain essentially unchanged relative to the maximum lift set during idling.

Another disadvantageous aspect of the mentioned dependency is also to be seen in that the direction of the control time shift is dependent on the rotational direction of the camshaft. For internal combustion engines in a V-arrangement and mirror-symmetric valve drives, this can have the undesired effect that the control times of gas-exchange valves of one cylinder bank are shifted with decreasing maximum lift in the direction of a retarded camshaft angle and the gas-exchange valves of the other cylinder bank are shifted with decreasing maximum lift simultaneously in the direction of an advanced camshaft angle. The synchronization of the control times for the two cylinder banks then absolutely necessary for the operation of the internal combustion engine would basically be possible through an overlapped angular adjustment of one or two camshafts, for example, through the use of a camshaft adjuster, would require, however, an exceptionally large adjustment range of the camshaft adjuster that can be reduced to practice only with difficulty due to the considerable and opposite control time shifts.

SUMMARY

Therefore, the object of the invention is to create a valve drive of the previously mentioned type, in which the cited disadvantages are overcome. Consequently, the valve drive should allow a variable transfer of the raised section of the cam to the gas-exchange valve, such that the maximum lift of the gas-exchange valve can be reduced continuously, while its control times remain essentially unchanged.

According to the invention, this objective is met in that the center of the displacement path is essentially identical to the rotational center of the bearing, when the contact surface interacts with a raised-section free base circle of the cam. Due to the resulting kinematic relationships between the base circle of the cam and the contact surface of the cam follower, the angular position of the contact surface relative to the cam and thus the control times of the gas-exchange valve remain constant for a change in position of the pivot bearing along its displacement path. The slight shift in the valve lift spread that occurs in all cases when the maximum lift changes, which is understood as the camshaft angle of the maximum lift relative to a top dead center point of the crankshaft, can be compensated when needed with relatively low expense through the use of a camshaft adjuster.

In a preferred improvement of the invention, the cam follower should have a base section, which connects the end section away from the cam to the end section close to the cam and which has a contoured bottom side, on which is arranged the transmission surface having a circular arc-shaped contour that extends around the rotational center of the bearing support. Here, the cam follower has side walls coming out of the base section that face the cam, with an essentially U-shaped cross section, wherein the bearing support is constructed as a pin located in bores through the side walls and fixed to the side walls in a positive-fit and/or non-positive fit connection, and the contact surface is constructed as a roller supported by a slide or roller bearing on the pin.

The cam follower constructed in this way represents an extremely compact and thus lightweight valve-drive component with high strength depending on shape with reference to high valve-drive stiffness. Under consideration of the contact excursion of the transmission surface relative to the shaft end of the gas-exchange valve, it is also conceivable as another lightweight measure that the cam follower is in direct contact with the shaft end of the gas-exchange valve. Alternatively, for a large contact excursion, however, the use of a component arranged between the transmission surface of the cam follower and the shaft end of the gas-exchange valve is possible. For such a component, a linearly guided cup tappet or another cam follower can be used, each with or without a hydraulic valve backlash compensation element. The use of a slide or roller bearing supported roller as the contact surface for the cam also guarantees a low-friction and thus low-loss operation of the valve drive.

In favor of lower production costs, it is further preferable that the base section is produced without cutting together with the side walls from a one-piece sheet-metal blank.

In addition, for the variable positioning of the pivot bearing on the displacement path, at least one transversely swinging rod should be provided, which extends adjacent to one of the side walls of the cam follower, which is connected on one end to the pivot bearing and which has, on the other end, an engagement contour, by means of which the transverse swinging rod can be driven about the center of the displacement path. The cam follower forms a compact, space-saving, and rotationally stiff component to be positioned in connection with such a transverse swinging rod.

Finally, the pivot bearing can be constructed as another pin, which is mounted on the side wall adjacent to the transverse swinging rod, which extends parallel to the pin and which has an end section projecting past the side wall as a hinge point for the transverse swinging rod. Alternatively, for example, the use of support elements, like those known as such from conventional drag lever valve drives with or without hydraulic valve backlash compensation, is also possible as pivot bearings if such support elements were expanded by suitable means for their displacement.

BRIEF DESCRIPTION OF THE DRAWINGS

The invention is explained in more detail with reference to the enclosed drawings, in which the basic kinematic principle and also an embodiment of the valve drive are shown. In the figures, the same reference symbols designate the same or functionally identical components, as long as nothing to the contrary is indicated. Shown are:

FIG. 3 is a plot of a group of lift curves that can be generated with the valve drive;

FIG. 4 is a simplified perspective view of an embodiment of the valve drive for a large maximum lift, and FIG. 5 is a view of the valve drive according to FIG. 4 for a small maximum lift.

DETAILED DESCRIPTION OF THE PREFERRED EMBODIMENT

Figure 1:
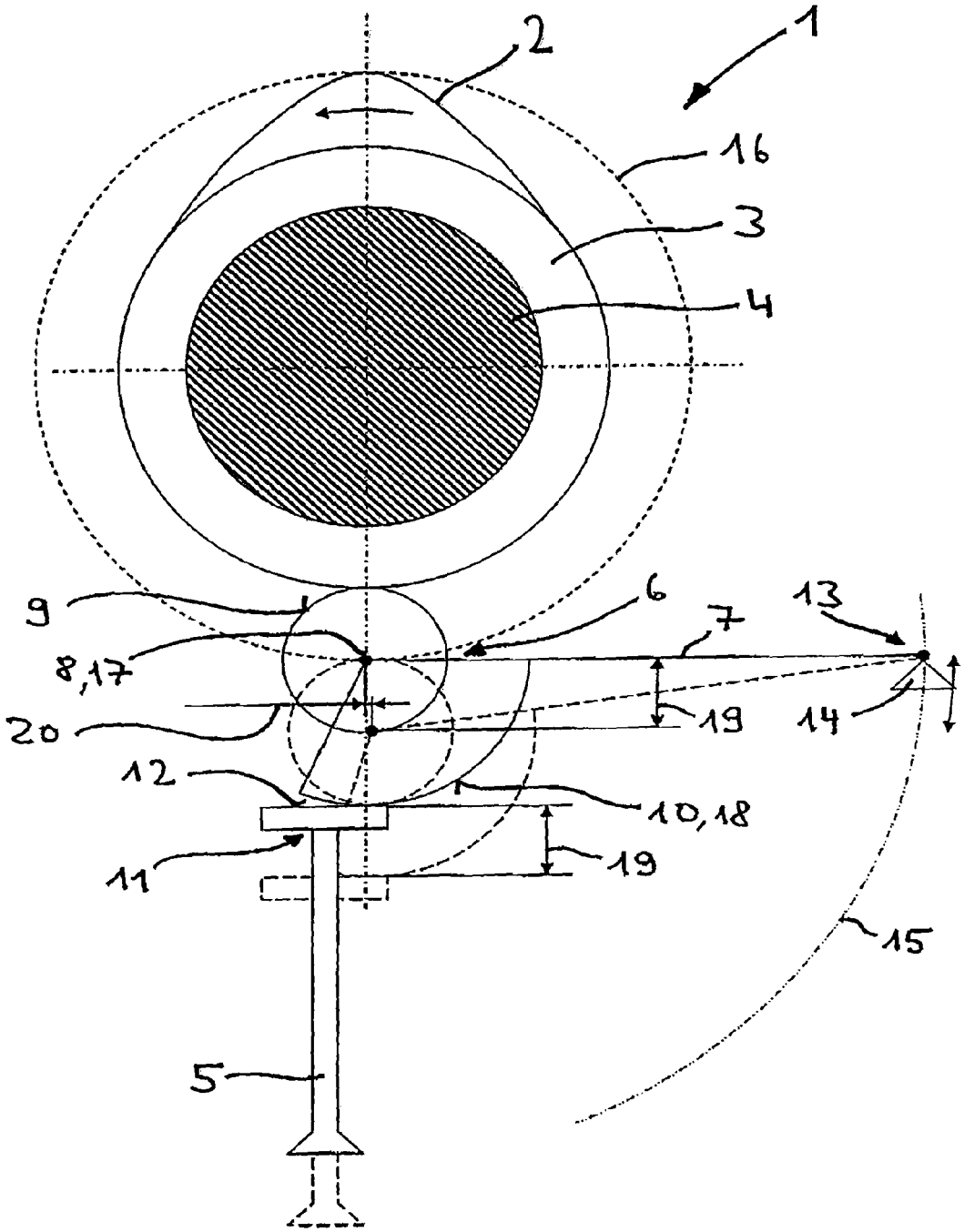
FIG. 1 is a kinematic schematic diagram of the valve drive for a large maximum lift.

In FIG. 1, the basic kinematics are disclosed for a valve drive 1 according to the invention, which is used for the variable, adjustable transfer of a raised section 2 of a cam 3 of a camshaft 4 to a gas-exchange valve 5, initially for a large maximum lift of the gas-exchange valve 5 with reference to a kinematic schematic diagram. An end section 6 close to the cam in a lever-like cam follower 7 has a support 8, on which a contact surface 9 for the cam 3 is mounted rotatably, and also a transmission surface 10 in active connection with the gas-exchange valve 5. The activation of the gas-exchange valve 5 is here shown greatly simplified through the contact between the transmission surface 10 and a receiver surface 12 arranged on a shaft end 11 of the gas-exchange valve 5. A corresponding arrangement also applies for the components, such as, for example, the valve springs which activate the gas-exchange valve 5 in the closing direction that are not shown here for simplification.

The cam follower 7 is supported with an end section 13 away from the cam on a pivot bearing 14, which can be positioned variably on a circular arc-shaped displacement path 15 for changing the valve lift as a function of the operating point of the internal combustion engine. The gas-exchange valve 5 is activated in the opening and closing direction in a known way, such that the raised section 2 of the cam 3, defining the circle 16 shown with dashed lines, rotates the cam follower 7 about the pivot bearing 14 into the position shown with dashed lines and the lift of the transmission surface 10 is transferred to this bearing in the lift direction of the gas-exchange valve 5. So that the transmission surface 10 has circular arc-shaped contour 18 about the rotational center 17 of the support 8, the center point movement of the transmission surface 10 can be decomposed into a first path component 19 corresponding to the valve lift and a second path component 20 orthogonal to the lift direction of the gas-exchange valve 5. As is visible from FIG. 1, for the shown position of the pivot bearing 14 on the displacement path 15, this second path component 20 is relatively small, so that the pivoting movement of the cam follower 7 generated by the raised section 2 of the cam 3 is active for the most part in the lift direction of the gas-exchange valve 5 corresponding to a large maximum lift.

Figure 2:
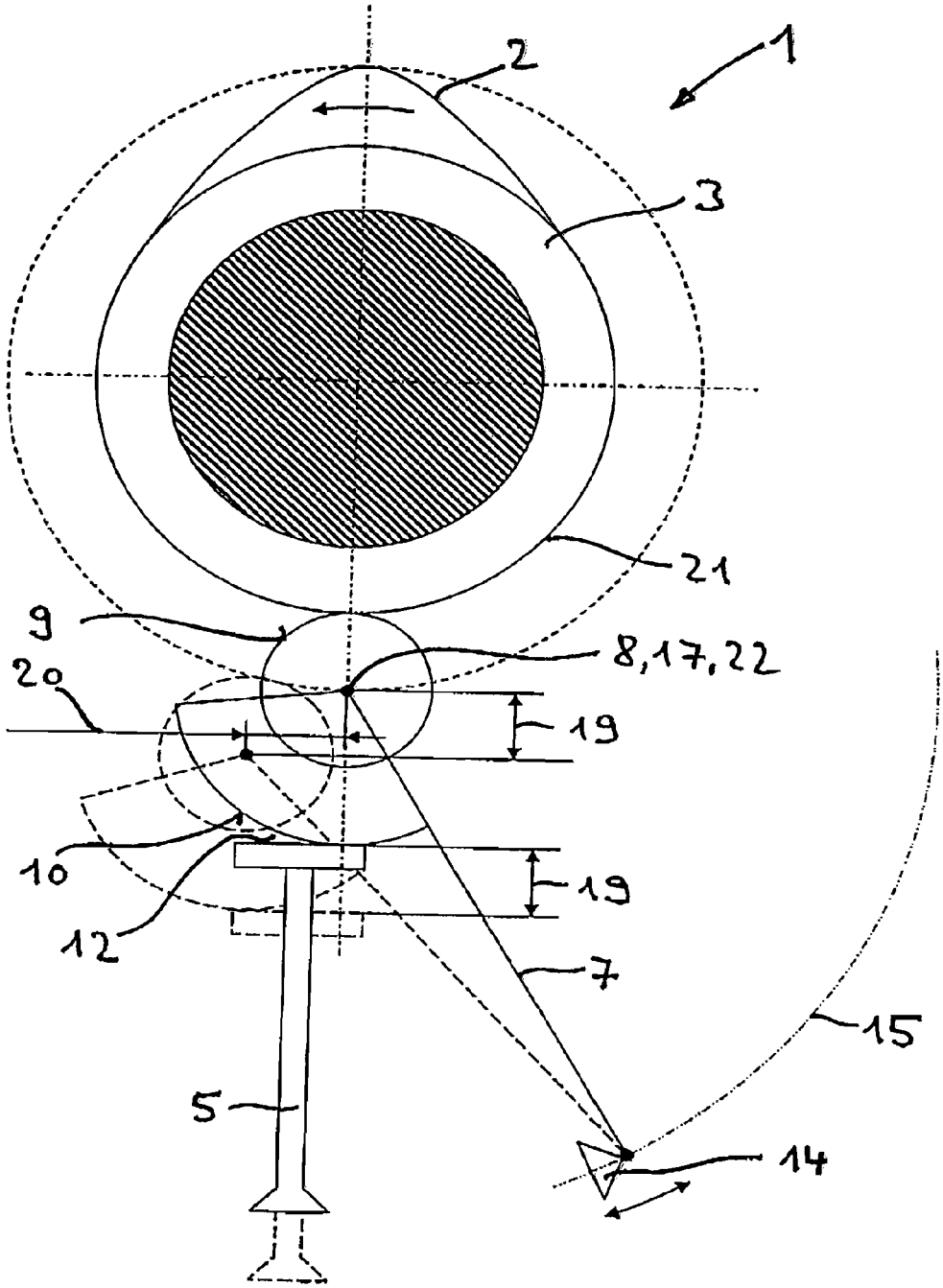
FIG. 2 is a kinematic schematic diagram of the valve drive for a small maximum lift.

A different transmission of the raised section 2 of the cam 3 to the gas-exchange valve 5 is shown in FIG. 2 with reference to the kinematic schematic diagram of the valve drive 1 with changed position of the pivot bearing 14 on the displacement path 15. The maximum lift of the gas-exchange valve 5 that is reduced relative to FIG. 1 is produced in that the center point movement of the transmission surface 10 for the pivoting movement of the cam follower 7 shown with dashed lines now has a relatively small first path component 19 corresponding to the valve lift and a now significantly larger second path component 20 orthogonal to the lift direction of the gas-exchange valve 5.

One property that is essential for the function of the valve drive 1 is also that the center of the displacement path 15 is essentially identical to the rotational center 17 of the support 8, when the contact surface 9 interacts with a raised section-free base circle 21 of the cam 3. This is a prerequisite for the condition that a change in position of the pivot bearing 14 on the displacement path 15 does not effect the position of the rotational center 17 of the support 8 and thus on the position of the contact point of the contact surface 9 relative to the base circle 21. Because the center point 22 of the transmission surface 10 is simultaneously identical with the rotational center 17 of the support 8, for a displacement of the pivot bearing 14 on the displacement path 15, the transmission surface 10 simultaneously rolls on the receiver surface 12, without generating a first path component 19 effective in the lift direction. In this respect, the gas-exchange valve 5 is activated neither in the opening nor closing direction even when the pivot bearing 14 is displaced, when the contact surface 9 interacts with the base circle 21 of the cam 3.

The latter condition is, in turn, a prerequisite for the successful integration of a hydraulic valve backlash compensation element in the valve drive 1. Such a valve backlash compensation element can be integrated, for example, into a cup tappet guided longitudinally and can act in a known way on the shaft end 11 of the gas-exchange valve 5. Simultaneously, the receiver surface 12 is formed by the cup base of the cup tappet, in order to maintain the excursion of the transmission surface 10 on the receiver surface 12 corresponding to the second path component 20 orthogonal to the lift direction of the gas-exchange valve 5. Alternatively, however, there is also the possibility to construct the pivot bearing 14 as a known hydraulic support element, which is equipped with suitable additional means for movement along the displacement path 15 for variable positioning.

A group of lift curves that can be generated with the valve drive 1 is produced in the diagram according to FIG. 3, in which opening profiles of the gas-exchange valve 5 are shown with different maximum lift L over the angular position ° C. of the cam 3. Thus, during the position of the pivot bearing 14 shown in FIG. 2, for example, the position of the pivot bearing 14 shown in FIG. 1 with the opening profile designated with α and corresponding to a large maximum lift leads to the opening profile designated with b with smaller maximum lift. It further follows from the diagram that the control times, i.e., the opening and closing times of the gas-exchange valve 5, remain constant independent of the respective maximum lift L. As already explained above, a displacement of the control times prevents the contact angle of the contact surface 9 from remaining unchanged relative to the base circle 21 of the cam 3 for a displacement of the pivot bearing 14. A slight displacement of the valve lift spread dependent on the actual kinematic relationships of the valve drive 1 results in the fact that the maximum lift L is achieved at different angular positions ° C. of the cam 3 according to the magnitude and direction of the second path component 20. If necessary, this displacement of the valve lift spread can be fully stabilized with relatively little expense through the use of a camshaft adjuster, which can be used otherwise meaningfully for changing the control times independent of the maximum lift L.

A structural embodiment of the valve drive 1 explained in FIGS. 1 and 2 with reference to the kinematic schematic diagram is disclosed in FIGS. 4 and 5. The valve drive 1 is located in the position of the maximum opening for the not completely shown gas-exchange valve 5. Here, in the position shown in FIG. 4 for the opening profile designated with a in FIG. 3 is generated with large maximum lift, while the maximum lift generated in FIG. 5 corresponds to the opening profile b of the FIG. 3. The position of the pivot bearing 14, which is different in FIGS. 4 and 5 and which can be positioned continuously on its displacement path 15 not shown here, is responsible for this feature.

The cam follower 7 is produced without cutting from a single-piece sheet-metal blank has an essentially U-shaped cross section with side walls 24 with a base section 23, which connects the end section 13 away from the cam to the end section 6 close to the cam, which extends out from the base section 23 and faces the cam 3. The support 8 for the contact surface 9 constructed as a slide or roller bearing-supported roller 25 for the cam 3 is constructed as a pin 27 mounted in bores 26 through the side walls 24 and fixed to the side walls 24 with a positive fit and/or non-positive fit. An especially economical and preferred attachment of the pin 27 is provided through a radial spreading of the ends of the pin 27 in a swaging process, as is known to someone skilled in the art of conventional drag or rocking levers.

The transmission surface 10 of the cam follower 7 acting directly on the gas-exchange valve 5 in this embodiment is arranged on a bottom side 28 of the base section 23 facing away from the cam 3 and has the circular arc-shaped contours 18 concentric to the pin 27.

The pivot bearing 14 is constructed as another pin 29, which is likewise attached to the side walls 24 and extends parallel to the pin 27 for the roller 25. Transverse swinging rods 30 adjacent to both side walls 24 are used for variable positioning of the pivot bearing 14 on its displacement path 15. An end section 31 of the other pin 29 supporting the associated transverse swinging rod 30 and projecting past a side wall 24 is used as the hinge point for the transverse swinging rod 30.

An engagement contour 32, which in this embodiment is constructed as a pin 33 that extends axis-parallel to the camshaft 4 and that can be connected to a not-shown adjustment drive, is used for the rotationally locked drive of each transverse swinging rod 30. According to the descriptions of FIGS. 1 and 2, according to which the displacement path 15 is concentric with the pin 27 for the roller 25, when the roller 25 interacts with the raised section-free base circle 21 of the cam 3, the pin 33 is then also concentric with the pin 27 when the contact surface 9 interacts with the base circle 21. The pin 33 can be connected to the adjustment drive using any type of shaft-hub connection known to someone skilled in the art. Alternatively, the pin 33 can also be replaced by a recess in the transverse swinging rod 30, in which the adjustment drive engages with complementary outer contours.

Likewise, any drives known to someone skilled in the art can also be considered as the adjustment drive. Preferably electromechanical and electrohydraulic drives are included here, which can be constructed as selective individual drives or as drives activating a group of cam followers in common.

| | |
|---|---|
| 1 | Valve drive |
| 2 | Raised section |
| 3 | Cam |
| 4 | Camshaft |
| 5 | Gas-exchange valve |
| 6 | End section close to cam |
| 7 | Cam follower |
| 8 | Support |
| 9 | Contact surface |
| 10 | Transmission surface |
| 11 | Shaft end |
| 12 | Receiver surface |
| 13 | End section away from cam |
| 14 | Pivot bearing |
| 15 | Displacement path |
| 16 | Circle |
| 17 | Rotational center of bearing |
| 18 | Contour |
| 19 | First path component |
| 20 | Second path component |
| 21 | Base circle |
| 22 | Center point of transmission surface |
| 23 | Base section |
| 24 | Side wall |
| 25 | Roller |
| 26 | Bore |
| 27 | Pin |
| 28 | Bottom side |
| 29 | Additional pin |
| 30 | Transversal swinging rod |
| 31 | End section |
| 32 | Engagement contour |
| 33 | Pin |
| L | Maximum lift |
| ° C. | Angular position of cam |

The invention claimed is:

1. Valve drive of an internal combustion engine comprising a lever-type cam follower, which is used for variable adjustable transmission of a raised section of a cam of a camshaft to a gas-exchange valve, the cam follower includes an end section away from the cam that is supported via a pivot bearing, which is variably positionable on a circular arc-shaped displacement path, and an end section close to the cam with a transmission surface in at least indirect active connection with the gas-exchange valve, and also with a support, on which support a contact surface for the cam is rotatably mounted, a center of the displacement path is essentially identical to a rotational center of the support, when the contact surface interacts with a raised section-free base circle of the cam.

2. Valve drive according to claim 1, wherein the cam follower has a base section connecting the end section away from the cam with the end section close to the cam with a bottom side, which faces away from the cam, and the transmission surface having a circular arc-shaped contour extending around the rotational center of the support is arranged on the bottom side.

3. Valve drive according to claim 2, wherein the cam follower further comprises side walls extending from the base section and also facing the cam forming an essentially U-shaped cross section, wherein the support is constructed as a pin mounted in bores through the side walls and fixed to the side walls in a positive fit and/or non-positive fit, and the contact surface is constructed as a roller supported by a slide or roller bearing on the pin.

4. Valve drive according to claim 3, wherein the base section is produced without cutting from a single-piece sheet-metal blank together with the side walls.

5. Valve drive according to claim 3, wherein at least one transverse swinging rod is provided for positioning the pivot bearing on the displacement path, the transverse swinging rod extends adjacent to one of the side walls of the cam follower, is connected on one end to the pivot bearing, and has on an other end an engagement contour, and the transverse swinging rod can be driven about the center of the displacement path by the engagement contour.

6. Valve drive according to claim 5, wherein the pivot bearing comprises an additional pin fixed to the side wall adjacent to the transverse swinging rod and extending parallel to the pin (27), wherein the additional pin has an end section projecting past the side wall as a hinge point for the transverse swinging rod.

* * * * *